US006161586A

United States Patent [19]

Hirata et al.

[11] Patent Number: 6,161,586

[45] Date of Patent: Dec. 19, 2000

[54] TOURNAMENT OIL PATH CONSTITUTING APPARATUS

[75] Inventors: Toichi Hirata, Ushiku; Genroku Sugiyama, Inashiki-gun; Tsukasa Toyooka, Higashiibaraki-gun; Norio Onuma, Matsudo; Ikuo Inagaki, Kasukabe; Masao Kashiwagi, Sagamihara, all of Japan

[73] Assignee: Hitachi Construction Machinery Co., Ltd., Japan

[21] Appl. No.: 09/267,957

[22] Filed: Mar. 12, 1999

[30] Foreign Application Priority Data

Mar. 16, 1998 [JP] Japan ..... 10-084958

[51] Int. Cl.[7] ..... F15B 13/08

[52] U.S. Cl. ..... 137/884; 60/427; 137/112; 137/596.13

[58] Field of Search ..... 60/427; 137/112, 137/596.13, 884

[56] References Cited

U.S. PATENT DOCUMENTS 4,249,557 2/1981 Habiger ..... 137/112

FOREIGN PATENT DOCUMENTS 61-36568 2/1986 Japan .

*Primary Examiner*—Gerald A. Michalsky

*Attorney, Agent, or Firm*—Steinberg & Raskin, P.C.

[57] ABSTRACT

A tournament oil path constituting apparatus in which while a laminated block is constituted by laminating a number of oil path plates, a number of shuttle valve holes and connection grooves made continuous to the shuttle valve holes are formed at overlap faces of the oil path plates, shuttle valves are integrated to the shuttle valve holes, introductory oil paths communicating with the shuttle valve holes are formed at both of the oil path plates formed with the shuttle valve holes and the oil path plates having match faces on sides of the shuttle valve holes and a high pressure oil is selected by the shuttle valves from pressure oils conducted both of the introductory oil paths and conducted to the connection grooves. The tournament oil path constituting apparatus also including a number of main paths penetrating the number of laminated oil path plates and branch grooves branched from the main paths.

6 Claims, 3 Drawing Sheets

TOURNAMENT OIL PATH CONSTITUTING APPARATUS

BACKGROUND OF THE INVENTION

1. Field of the Invention

The present invention relates to a tournament oil path constituting apparatus having shuttle valves for selecting the highest pressure of a circuit.

2. Description of the Related Art

An apparatus according to the conventional example shown by FIG. 3 is constituted by a pilot valve section 9 for controlling pressurized oil from a pilot pump Pp, a control valve section 10 connected with a plurality of actuators, a first through an eighth pilot path 1 through 8 for connecting the both sections 9 and 10, a tournament section x for selecting the highest pressure of the first through the eighth pilot paths 1 through 8 and a pump control valve 15 for controlling a delivery amount of a main pump Pm.

The pilot valve section 9 is connected with the pilot pump Pp, controls delivery oil from the pilot pump Pp and supplies pilot pressure to the first through the eighth pilot paths 1 through 8.

The control valve section 10 is constituted by a first through a fourth switch valve 11 through 14 connected to the main pump Pm via a neutral path 19 and a parallel path 30. The first through the fourth switch valves 11 through 14 are connected with actuators A, B, C and D. Further, pilot chambers 21 through 28 of the first through the fourth switch valves 11 through 14 are respectively connected with the first through the eighth pilot paths 1 through 8 for conducting pilot pressure from the pilot valve section 9 to the pilot chambers 21 through 28.

The first through the fourth switch valves 11 through 14 constructed in this way maintain illustrated neutral positions in a normal state and discharge the delivery oil from the main pump Pm to a tank T via the neutral path 19→neutral ports 11*a* through 14*a* of the first through the fourth switch valves→a tank path 20. Further, when the pilot pressure is conducted to either of the pilot chambers, the switch valve is switched to either of left and right positions and supplies the delivery oil from the main pump Pm from the parallel path 30 to the actuator via the switch valve. Further, return oil from the actuator is discharged to the tank T via the tank path 20.

Further, the tournament section x comprises a plurality of shuttle valves and a tournament circuit is constituted by the shuttle valves. Further, the tournament section x is connected with a first to an eighth branch path 31 through 38 for conducting pilot pressure in the first through the eighth pilot paths 1 through 8. The shuttle valves of the tournament section x select oil at the highest pressure among the conducted pilot pressure and conduct it to a pilot chamber 15*a* of the pump control valve 15.

As such a tournament section x constructed as described above, for example, there is used one constituted by integrating a plurality of shuttle valves of a poppet type to a single body block or one described in JP-A-61-36568 in which a plurality of plates formed with oil paths and shuttle valves are laminated together.

Meanwhile, an auxiliary pump Ps is connected to a primary pressure port 16 and a supply pressure chamber 15*b* of the pump control valve 15 and a pump controlling cylinder 18 is connected to a control port 17. Further, a spring s is installed to a side of the pilot chamber 15*a* and the spring force is exerted on a spool of the pump control valve 15.

The pump control valve 15 constructed in this way is for controlling the delivery amount of the main pump Pm by moving a rod 18*a* of the pump controlling cylinder 18 and the spool is moved to a position at which thrust caused by the pilot pressure conducted to the pilot chamber 15*a,* thrust caused by the delivery pressure from the auxiliary pump Ps conducted to the supply pressure chamber 15*b* and the spring force of the spring s are balanced. Further, the control port 17 is communicated with a side of the pump port 16 or communicated with a side of a tank port 29 in accordance with the switch position of the spool. When the control port 17 and the tank port 29 are communicated with each other, the pump controlling cylinder 18 is moved in the left direction of the drawing by spring force of a control spring 39 installed to the rod 18*a.* Conversely, when the control port 17 and the pump port 16 are communicated with each other, delivery oil from the auxiliary pump Ps is supplied to a chamber of the pump controlling cylinder 18 and the rod 18*a* is moved in the right direction of the drawing. Further, the delivery amount of the main pump Pm is controlled in accordance with a position of moving the rod 18*a*.

Next, an explanation will be given of operation of the apparatus according to the conventional example.

For example, when pilot pressure is supplied to the pilot chamber 21 of the first switch valve 11 and the pilot chamber 24 of the second switch valve 12 via the first and the fourth pilot paths 1 and 4, the first switch valve 11 is switched to a switch position on the right side of the drawing and the second switch valve 12 is switched to a switch position on the left side of the drawing. Therefore, delivery oil from the main pump Pm is supplied from the parallel path 30 to the actuators A and B via the first and the second switch valves 11 and 12. Therefore, the actuator A is rotated either one of directions and the actuator B is rotated in other of directions.

Further, at this occasion, pilot pressures in the first and the fourth pilot paths 1 and 4 are respectively conducted to the tournament section x via the first and the fourth branch paths 31 and 34. With regard to the conducted pilot pressures, high pressure oil is selected by the shuttle valves and the high pressure oil is conducted to the pilot chamber 15*a* of the pump control valve 15. The pump control valve 15 is switched to a position at which thrust caused by the pilot pressure, thrust caused by delivery pressure of the auxiliary pump Ps conducted to the supply pressure chamber 15*b* and spring force of the spring s are balanced. When the pump control valve 15 is switched, the rod 18*a* of the pump controlling cylinder 18 is also moved in accordance with the switch position and the delivery amount of the main pump Pm is controlled in accordance with the position of moving the rod 18*a*. Further, the delivery oil from the main pump Pm controlled in this way is supplied to the actuators A and B.

According to the conventional apparatus, the first through the eighth pilot paths 1 through 8 and the tournament section x selecting the highest pressure in the first through the eighth pilot paths 1 through 8 are connected via the first through the eighth branch paths 31 through 38 and accordingly, volume of inside of flow path for conducting the pilot pressure is increased by an amount of the volume of the first through the eighth branch paths 31 through 38. Further, the tournament section x and the pump control valve 15 are also connected via a pipe and accordingly, the volume of the inside of the flow path is further increased. When the volume of the inside of the flow path is increased in this way, response of the pilot pressure conducted at the inside of the flow path is deteriorated. As a result, there poses a problem in which switch response of the pump control valve 15 is deteriorated.

Further, when the volume of the inside of the flow path is increased, temperature rise of oil at the inside of the flow path is retarded. Therefore, there poses also a problem in which it takes time in start operation for the oil to reach predetermined temperature and the response during the time period is deteriorated.

Meanwhile, when the volume of the inside of the flow path is large, air is difficult to exclude and there is a case in which air remains when oil is supplied to the circuit. When air remains at inside of the flow path in this way, there poses a problem in which transmission of the pilot pressure cannot be carried out smoothly.

Further, the tournament section x and the pump control valve 15 are separately installed and accordingly, there poses a problem in which the apparatus becomes large-sized.

SUMMARY OF THE INVENTION

It is an object of the invention to provide a tournament oil path constituting apparatus having excellent response and capable of being downsized.

According to a first aspect of the invention, there is provided a tournament oil path constituting apparatus in which while a laminated block is constituted by laminating a plurality of oil path plates, pluralities of shuttle valve holes and connection grooves made continuous to the shuttle valve holes are formed at overlap faces of the oil path plates, shuttle valves are integrated to the shuttle valve holes, introductory oil paths communicating with the shuttle valve holes are formed at both of the oil path plates formed with the shuttle valve holes and the oil path plates having match faces on sides of the shuttle valve holes and a high pressure oil is selected by the shuttle valves from pressure oils conducted to the both introductory oil paths and conducted to the connection grooves, the tournament oil path constituting apparatus comprising a plurality of main paths penetrating the plurality of laminated oil path plates and not intersecting with each other, and branch grooves branched from the main paths, wherein the branch grooves are communicated with the introductory oil paths.

According to a second aspect of the invention, a plurality of the branch grooves are branched from a single or a plurality of the main paths.

According to a third aspect of the invention, there is provided the tournament oil path constituting apparatus according to the above aspects, further comprising a spool slidably integrated to inside of the oil path plate, a pilot chamber which an end portion of the spool faces, and a supply pressure chamber for supplying a primary pressure, wherein the connection grooves are connected to both or either of the pilot chamber and the supply pressure chamber and the high pressure oil selected by the shuttle valves is conducted to the pilot chamber as a switch pressure and to the supply pressure chamber as a signal supply pressure.

DETAILED DESCRIPTION OF THE PREFERRED EMBODIMENTS

Figure 1:
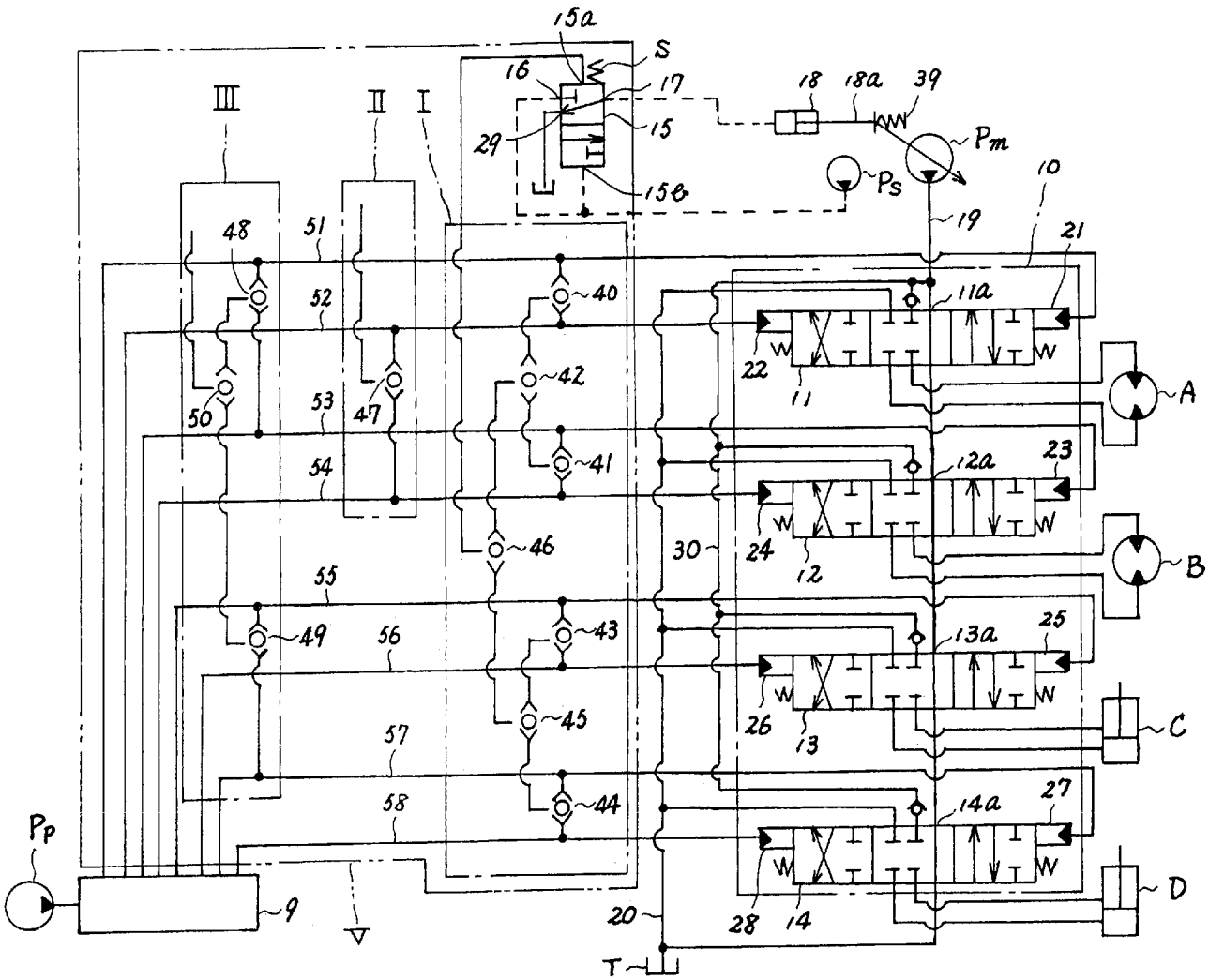
FIG. 1 is a circuit diagram representing a total of an apparatus according to an embodiment.
Figure 2:
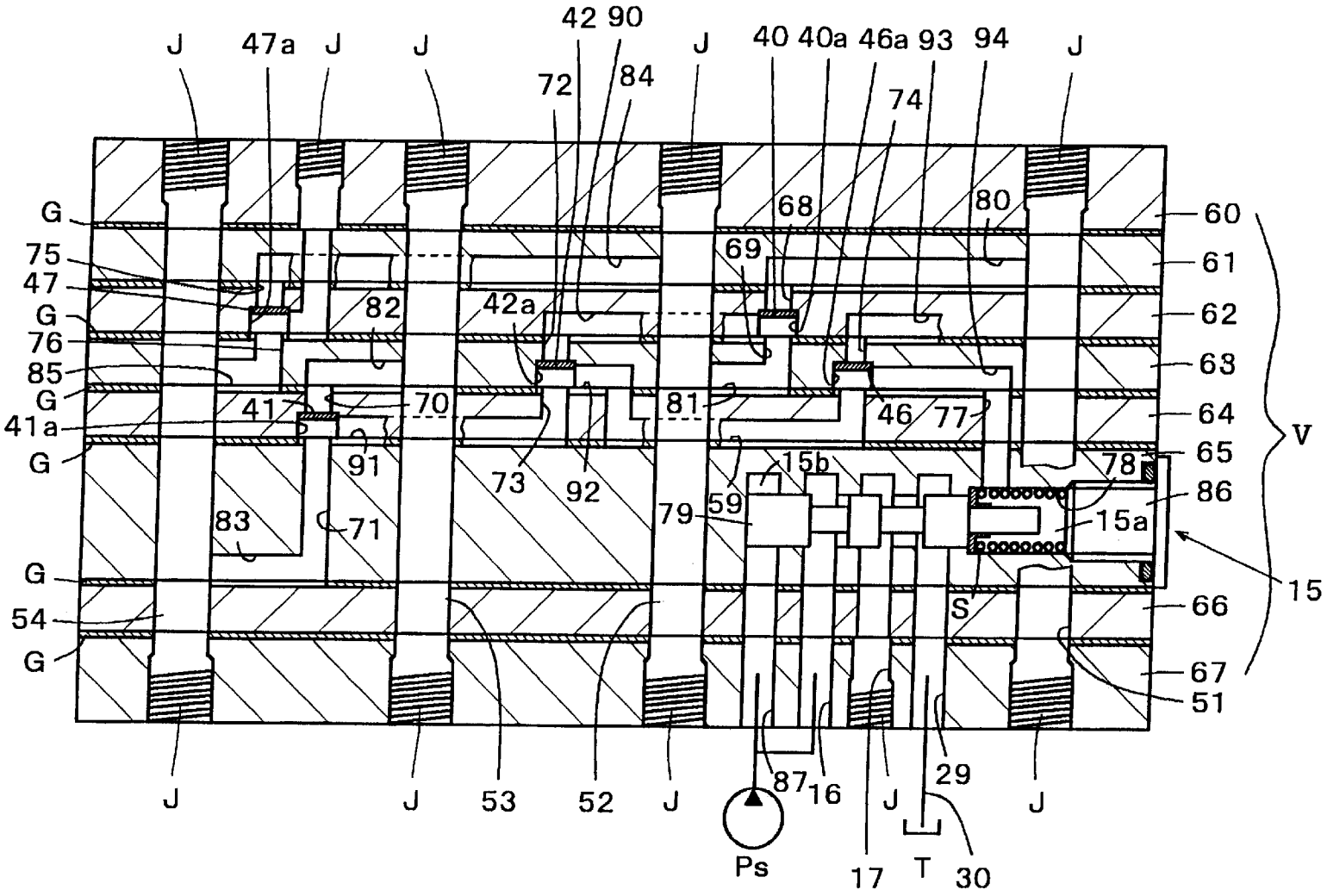
FIG. 2 is a sectional view of a laminated block according to the embodiment.
Figure 3:
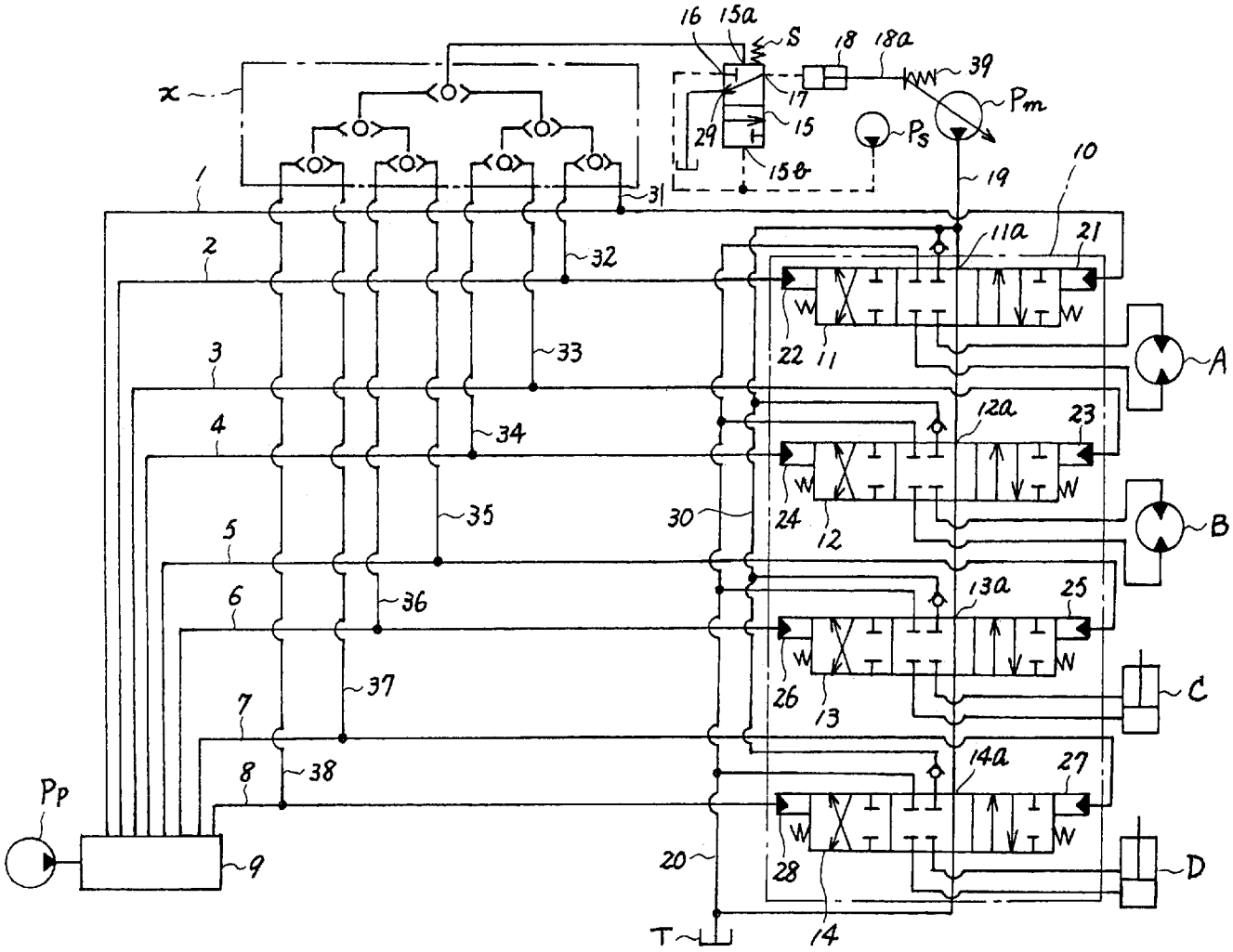
FIG. 3 PRIOR ART
FIG. 3 is a circuit diagram of an apparatus according to a conventional example.

According to an embodiment shown by FIGS. 1 and 2, the pilot valve section 9 and the control valve section 10 are connected by a first through an eighth pilot path 51 through 58 and a tournament section is installed among the first through the eighth pilot paths 51 through 58. However, the pilot valve section 9 and the control valve section 10 are the same as those in the above-described conventional example and therefore, the same notations are attached to the same constituent elements, a detailed explanation thereof will be omitted and an explanation will be given here centering on the tournament section.

As shown by FIG. 1, the first and the second pilot paths 51 and 52 are connected via a shuttle valve 40 and the third and the fourth pilot paths 53 and 54 are connected via a shuttle valve 41. Further, high pressure oil selected by the shuttle valves 40 and 41 is conducted to a shuttle valve 42.

Further, the fifth through the eighth pilot paths 55 through 58 are also connected by shuttle valves 43 and 44 similar to the above-described and high pressure oil selected by the shuttle valves 43 and 44 is conducted to a shuttle valve 45. Further, the shuttle valve 42 and the shuttle valve 45 are connected via a shuttle valve 46 and high pressure oil selected by the shuttle valve 46 is conducted to the pilot chamber 15*a* of the pump control valve 15 as switch pressure.

Further, the tournament section constituted by the shuttle valves 40 through 46 mentioned above is defined as a first tournament section I.

Further, the first through the eighth pilot paths 51 through 58 correspond to main paths of the invention.

A second and a third tournament section II and III are installed on the left side of the first tournament section I of the drawing.

In the second tournament section II, the second and the fourth pilot paths 52 and 54 are connected via a shuttle valve 47. Further, high pressure oil selected by the shuttle valve 47 is conducted to a pilot chamber or a supply pressure chamber of a control valve, not illustrated, respectively as switch pressure or signal supply pressure.

Further, in the third tournament section III, the first and the third pilot paths 51 and 53 are connected via a shuttle valve 48 and the fifth and the seventh pilot paths 55 and 57 are connected via a shuttle valve 49. Further, high pressure oil selected by the shuttle valves 48 and 49 is conducted to a shuttle valve 50 and high pressure oil selected by the shuttle valve 50 is also conducted to a pilot chamber or a supply pressure chamber of a control valve, not illustrated, respectively as switch pressure or signal supply pressure.

FIG. 2 is a sectional view of a laminated block V specifying a portion V surrounded by a two-dotted chain line in FIG. 1. Further, the sectional view shows only a portion of the first tournament section I mentioned above, the second tournament section II and the pump control valve 15 and constituent elements the same as those in FIG. 1 are attached with the same notations.

The laminated block V is constituted by fixing a plurality of oil path plates 60 through 67 by bolts, not illustrated, and the oil path plates 60 through 67 are formed with grooves, holes and so on by machining or die casting. Further, when the oil path plates 60 through 67 are laminated together, the first through the fourth pilot paths 51 through 54 penetrating from the upper side to the lower side of the drawing are formed. Although the first through the fourth pilot paths 51 through 54 are formed linearly according to the embodiment, these may be formed in meandering shapes. However, when the respective pilot paths intersect with each other, they must not be communicated with each other.

In the laminated block V, shuttle valve holes 40*a* through 42*a*, 46*a* and 47*a* are formed and the shuttle valves 40 through 42, 46 and 47 are integrated to the shuttle valve holes.

The above-described shuttle valve hole 40*a* is respectively communicated with an introductory oil path 68 formed in the oil path plate 62 and an introductory oil path 69 formed in the oil path plate 63. Further, the introductory oil path 68 is communicated with a branch groove 80 branched from the first pilot path 51 and the introductory oil path 69 is connected with a branch groove 81 branched from the second pilot path 52.

The shuttle valve hole 41*a* is respectively connected with an introductory oil path 70 formed in the oil path plate 64 and an introductory oil path 71 formed in the oil path plate 65. Further, the introductory oil path 70 is connected with a branch groove 82 branched from the third pilot path 53 and the introductory oil path 71 is connected with a branch groove 83 branched from the fourth pilot path 54.

The shuttle valve holes 40*a* and 41*a* are respectively connected with connection grooves 90 and 91 for conducting high pressure oil selected by the shuttle valves 40 and 41. Further, the connection grooves 90 and 91 are connected to the shuttle valve hole 42*a* via introductory oil paths 72 and 73.

Further, the shuttle valve hole 42*a* is connected with a connection groove 92 for conducting high pressure oil selected by the shuttle valve 42 and the connection groove 92 is connected to the shuttle valve hole 46*a* via a communication path 59 formed in the oil path plate 64. Further, the shuttle valve hole 46*a* is conducted with the highest pilot pressure of the fifth through the eighth pilot paths 55 through 58, not illustrated, via a connection groove 93 and an introductory path 74.

The first tournament section I is constructed by the above-described constitution.

Further, the shuttle valve hole 47*a* is respectively connected with an introductory oil path 75 communicating with a branch groove 84 branched from the second pilot path 52 and an introductory oil path 76 communicating with a branch groove 85 branched from the fourth pilot path 54 and the second tournament section II shown by FIG. 1 is constructed by the constitution.

Meanwhile, a spool hole 78 is formed in the oil path plate 65 and a spool 79 is slidably integrated thereto. Further, the pilot chamber 15*a* is constituted by closing one end of the spool hole 78 by a cap 86. The pilot chamber 15*a* is installed with the spring S and high pressure oil selected by the shuttle valve 46*a* is conducted thereto via a connection groove 94 and an oil path 77.

Further, the spool hole 78 is communicated with primary pressure ports 87 and 16, the control port 17 and the tank port 29 successively from the left side of the drawing. Further, the primary pressure ports 87 and 16 are connected with the auxiliary pump Ps and pressure oil from the auxiliary pump Ps is supplied as signal supply pressure. Further, the control port 17 is connected with the cylinder 18 for controlling pump shown by FIG. 1 and the tank port 29 is connected with the tank T via the tank path 30. The pump control valve 15 shown by FIG. 1 is constructed by such a constitution. Further, the pump control valve 15 supplies pressurized oil from the auxiliary pump Ps to the pump controlling cylinder 18 or discharges return oil from the pump controlling cylinder 18 to the tank T in accordance with the switch position of the spool 79.

Further, notation J designates a screw portion for connecting a joint and notation G designates a seal member for preventing leakage of pressure oil from match faces of the oil path plates.

Further, the primary pressure ports 87 and 16 and the supply pressure chamber 15*b* according to the embodiment correspond to a pressure supply chamber of the invention.

Further, although only a portion of the circuit in FIG. 1 is shown in the sectional view of FIG. 2, in the laminated block V, the fifth through the eighth pilot paths 55 through 58 and other tournament section are also constituted. Further, spools of control valves for conducting the highest pressure of the respective tournament sections are integrated to the laminated block V.

According to the embodiment, the first through the third tournament sections I through III as well as the pump control valve 15 can be integrated to the inside of the laminated block V constituting the first through the eighth pilot paths 51 through 58 and accordingly, it is not necessary to particularly install pipes for connecting the first through the eighth pilot paths 51 through 58 and the first through the third tournament sections I through III and pipes for connecting the first through the third tournament sections I through III and the pump control valve 15 as in the conventional example. The volume of the inside of the flow path can be reduced by an amount necessary for particularly installing the pipes in this way and the switch response of the pump control valve 15 can be promoted.

Further, the tournament sections as well as the pump control valve 15 are integrated to the laminated block V constituting the pilot paths and accordingly, not only the apparatus can be downsized but also extra pipes are reduced and a reduction in cost can be achieved.

Further, by making a plurality of branch grooves branch from one pilot path, a plurality of tournament sections can be constituted in one laminated block V. Further, when the control valves for supplying high pressure oil selected by the respective tournament sections are also integrated to the laminated block V, higher response can be achieved.

Further, although according to the embodiment, high pressure oil selected by the tournament sections is utilized as pilot pressure, high pressure oil selected by the tournament sections may be conducted to the primary pressure ports 16 and 87 to thereby utilize as primary pressure in place of the auxiliary pump Ps.

According to the first aspect of the invention, by constructing the tournament oil paths in the laminated block installed with the main paths, pipes need not to install particularly. Accordingly, the volume of the inside of the flow path can be reduced by the amount of the pipes and response of the pilot pressure can be promoted.

Further, the product cost can be reduced by an amount dispensing with the pipes.

According to the second aspect of the invention, by making the plurality of branch grooves branch from one main path, a plurality of the tournament oil paths can be constituted in the laminated block.

According to the third aspect of the invention, the spool of the control valve for conducting high pressure oil selected by the shuttle valves can be installed in the laminated block and accordingly, the switch response of the control valve can further be promoted.

What is claimed is:

1. A tournament oil path constituting apparatus in which while a laminated block is constituted by laminating a plurality of oil path plates, pluralities of shuttle valve holes and connection grooves made continuous to the shuttle valve holes are formed at overlap faces of the oil path plates, shuttle valves are integrated to the shuttle valve holes, introductory oil paths communicating with the shuttle valve holes are formed at both of the oil path plates formed with the shuttle valve holes and the oil path plates having match faces on sides of the shuttle valve holes and a high pressure oil is selected by the shuttle valves from pressure oils conducted to the both introductory oil paths and conducted to the connection grooves, the tournament oil path constituting apparatus comprising:

a plurality of main paths penetrating the plurality of laminated oil path plates and not intersecting with each other; and branch grooves branched from the main paths;

wherein the branch grooves are communicated with the introductory oil paths.

2. The tournament oil path constituting apparatus according to claim 1, wherein a plurality of the branch grooves are branched from at least one of the main paths.

3. The tournament oil path constituting apparatus according to claim 2, further comprising:

a spool slidably integrated to inside of the oil path plate;

a pilot chamber which an end portion of the spool faces; and a supply pressure chamber for supplying a primary pressure;

wherein the connection grooves are connected to at least one of the pilot chamber and the supply pressure chamber.

4. The tournament oil path constituting apparatus according to claim 3, wherein the connection grooves are connected to both of the pilot chamber and the supply pressure chamber and the high pressure oil selected by the shuttle valves is conducted to the pilot chamber as a switch pressure and to the supply pressure chamber as a signal supply pressure.

5. The tournament oil path constituting apparatus according to claim 1, further comprising:

a spool slidably integrated to inside of the oil path plate;

a pilot chamber which an end portion of the spool faces; and a supply pressure chamber for supplying a primary pressure;

wherein the connection grooves are connected to at least one of the pilot chamber and the supply pressure chamber.

6. The tournament oil path constituting apparatus according to claim 5, wherein the connection grooves are connected to both of the pilot chamber and the supply pressure chamber and the high pressure oil selected by the shuttle valves is conducted to the pilot chamber as a switch pressure and to the supply pressure chamber as a signal supply pressure.

* * * * *

UNITED STATES PATENT AND TRADEMARK OFFICE

CERTIFICATE OF CORRECTION

PATENT NO. : 6,161,586
DATED : December 19, 2000
INVENTOR(S) : Hirata et al.

It is certified that error appears in the above-identified patent and that said Letters Patent is hereby corrected as shown below:

Title page,
Item [73], Assignee: please include -- Kayaba Industry Co., Ltd. --.

Signed and Sealed this

Ninth Day of July, 2002

*Attest:*

*Attesting Officer*

JAMES E. ROGAN
*Director of the United States Patent and Trademark Office*